US008115045B2

(12) United States Patent
Jones, III et al.

(10) Patent No.: US 8,115,045 B2
(45) Date of Patent: Feb. 14, 2012

(54) NUCLEAR WASTE REMOVAL SYSTEM AND METHOD USING WET OXIDATION

(75) Inventors: Sidney Dennis Jones, III, Lynchburg, VA (US); Ray Beatty, Lynchburg, VA (US); John Remark, Lynchburg, VA (US); Wesley Hudson, Lynchburg, VA (US)

(73) Assignee: AREVA NP Inc., Lynchburg, VA (US)

( * ) Notice: Subject to any disclaimer, the term of this patent is extended or adjusted under 35 U.S.C. 154(b) by 713 days.

(21) Appl. No.: 11/982,640

(22) Filed: Nov. 2, 2007

(65) Prior Publication Data

US 2009/0118560 A1 May 7, 2009

(51) Int. Cl.

| | |
|---|---|
| ***G21F 9/00*** | (2006.01) |
| ***G21F 9/14*** | (2006.01) |
| ***G21F 9/20*** | (2006.01) |
| ***A62D 3/30*** | (2007.01) |

(52) U.S. Cl. ..... 588/318; 588/1; 588/18; 588/20; 588/313; 588/400

(58) Field of Classification Search ..... 588/1–20, 588/300–321, 400–415

See application file for complete search history.

(56) References Cited

U.S. PATENT DOCUMENTS

| | | | | |
|---|---|---|---|---|
| 3,873,362 | A * | 3/1975 | Mihram et al. | 134/3 |
| 5,523,513 | A * | 6/1996 | Milner | 588/1 |
| 5,585,531 | A * | 12/1996 | Barker et al. | 588/20 |
| 5,752,206 | A * | 5/1998 | Frink et al. | 588/20 |
| 5,960,368 | A | 9/1999 | Pierce et al. | |
| 6,335,475 | B1 * | 1/2002 | Nagase et al. | 588/18 |
| 6,444,276 | B2 | 9/2002 | Bertholdt | |
| 6,865,244 | B2 | 3/2005 | Meseth | |
| 2007/0153957 | A1 | 7/2007 | Gely et al. | |
| 2009/0118560 | A1 * | 5/2009 | Jones et al. | 588/20 |

OTHER PUBLICATIONS

"Tank Waste Retrieval, Processing and On-site Disposal at Three Department of Energy Sites: Final Report" National Research Council (2006) ISBN 978-0-309-10170-7 Chapters III and IX.

* cited by examiner

*Primary Examiner* — Jerry Lorengo
*Assistant Examiner* — Jennifer Smith
(74) *Attorney, Agent, or Firm* — Davidson, Davidson & Kappel, LLC

(57) ABSTRACT

Methods for removing nuclear waste from a component are provided. In one embodiment, the method includes the steps of supplying oxalic acid to the nuclear waste on the component to form an oxalic acid/waste solution, feeding the oxalic acid/waste solution from the component, feeding an oxidant to the oxalic acid/waste solution to form carbon-dioxide, water and a precipitate, and separating the precipitate from the water. A system for removing nuclear waste is also provided.

24 Claims, 1 Drawing Sheet

NUCLEAR WASTE REMOVAL SYSTEM AND METHOD USING WET OXIDATION

The present invention relates generally to components containing nuclear waste and more particularly to removing such waste from the components. Nuclear waste as defined herein is unwanted deposits, sludges, or salts that reside in a tank, vessel or heat exchanger that are generated during normal operation of a nuclear power plant or other nuclear materials facility.

BACKGROUND

U.S. Pat. No. 5,960,368 discloses a "wet" oxidation process for reducing the volume of low level radioactive and mixed waste to enable the waste to be more economically stored in a suitable repository, and for placing the waste into a form suitable for permanent disposal.

U.S. Pat. No. 6,444,276, hereby incorporated by reference, discloses a method for decontaminating a surface that includes the steps of bringing a surface of a component formed of an unalloyed steel or a low-alloy steel into contact with a solution containing an oxalic acid for dissolving a contaminated layer from the component.

One of the most common components containing nuclear waste is a waste tank. Retrieval of waste from nuclear waste tanks is described in, for example, "Tank Waste Retrieval, Processing and On-site Disposal at Three Department of Energy Sites: Final Report" National Research Council (2006) ISBN 978-0-309-10170-7.

As described therein, tank waste typically includes supernatant liquid, saltcake and sludge. Typically, in a first retrieval step called bulk waste retrieval, the supernatant liquid is removed using a transfer pump. The saltcake typically is dissolved in water. The resulting solution is then pumped in the same manner as the supernatant liquid. The sludge may be mobilized using larger mixer pumps that mix the sludge into a slurry by directing a jet of water into the waste layer, and this slurry also is pumped out.

What remains after this bulk waste retrieval is called residual waste. The residual waste often includes radioactive material on the internal surfaces of the tank above the level of waste in the bottom of the tank and wastes composed of agglomerated materials such as those in sludge that resist physical removal techniques, for example, zeolites and other metallic species.

Both physical and chemical technologies have been employed to retrieve residual waste. Oxalic acid has been used to dissolve sludge, but concerns have been raised as listed at page 38 of "Tank Waste Retrieval, Processing and On-site Disposal at Three Department of Energy Sites: Final Report." National Research Council (2006).

This reference also notes that "[d]ownstream problems could be addressed by destroying oxalic acid and metal oxalates after tank cleaning" but notes issues with using oxidants such as ozone. See "Tank Waste Retrieval, Processing and On-site Disposal at Three Department of Energy Sites: Final Report." National Research Council 103 (2006).

As opposed to nuclear waste removal, decontamination of nuclear power plants has used a Chemical Oxidation Reduction Decontamination (CORD) process to destroy oxalate chemistry during the chemical decontamination process. In the CORD process, oxalate-based chemistry solubilizes corrosion products at high temperatures, for example, approximately 195° F. After the corrosion products are solubilized and the reaction is complete, the oxalic acid chemistry is destroyed by oxidation leaving only the metals that are removed on ion exchange resin. These processes are used on the primary coolant loop (PCL) of the nuclear power plant for purposes of radiation dose-reduction, but have not been known for addressing wastes such as tank waste.

SUMMARY OF THE INVENTION

An object of the present invention is to provide effective and efficient waste removal using a chemical process, while permitting efficient handling of resultant downstream secondary waste.

The present invention provides a method for removing nuclear waste from a component comprising:

supplying oxalic acid to the nuclear waste on the component to form an oxalic acid/waste solution;

feeding the oxalic acid/waste solution from the component;

feeding an oxidant to the oxalic acid/waste solution to form carbon-dioxide, water and a precipitate; and separating the precipitate from the water.

The present invention also provides a system for removing nuclear waste from a component comprising:

an oxalic acid supply;

a first pump connecting the oxalic acid supply to waste on the component;

a second pump removing the oxalic acid/waste solution from the component;

an oxidant supply;

a decomposition unit receiving oxidant from the oxidant supply and the oxalic acid/waste solution from the second pump, water and a precipitate being formed therein; and a solid separator receiving the water and the precipitate from the decomposition unit.

The present invention also provides a method for removing nuclear waste from a component comprising:

supplying oxalic acid to the nuclear waste on the component to form an oxalic acid/waste solution;

feeding the oxalic acid/waste solution from the component; and processing the oxalic acid/waste solution through ion exchange media or water purification method.

BRIEF DESCRIPTION OF THE DRAWING

One preferred embodiment of the present invention will be described with respect to the drawing in which.

DETAILED DESCRIPTION OF THE PREFERRED EMBODIMENT

Figure 1:
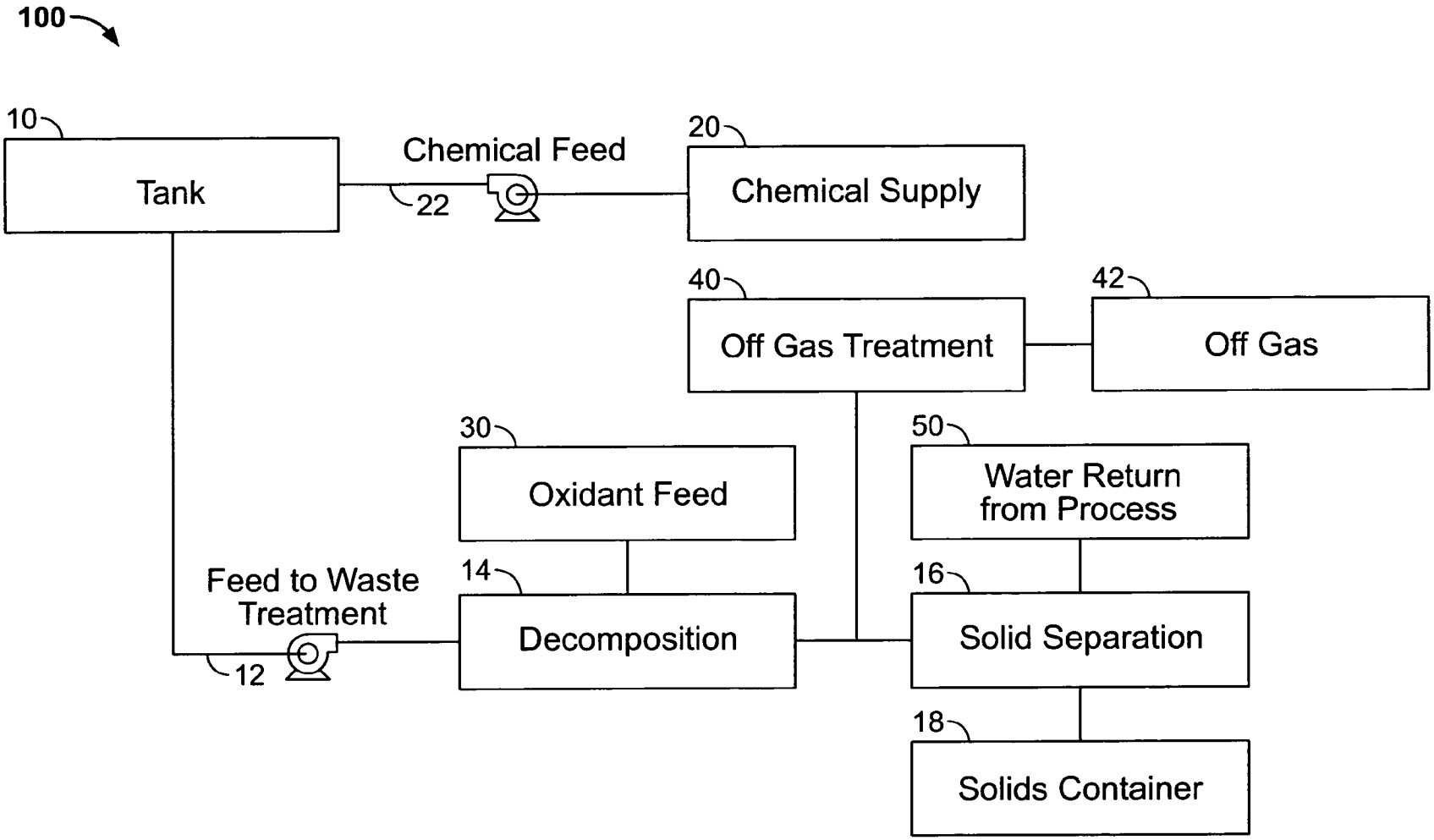
FIG. 1 shows a chemical cleaning process and system diagram in accordance with the present invention.

FIG. 1 shows schematically a chemical cleaning system 100. A tank 10, or other component with wastes to be cleaned, for example, heat transfer equipment or secondary piping system, for example, as disclosed in U.S. Patent Publication No. 2007/0153957 and U.S. Pat. No. 6,865,244 which are hereby incorporated by reference, is located outside of a primary coolant loop of a nuclear reactor. The primary coolant loop may be running, while chemical cleaning system 100 is employed.

Tank 10 may include tank wastes, such as deposits and sludge, which need to be removed. Tank wastes may include nuclear waste including copper, aluminum, sodium and iron materials. Tank 10 receives oxalic acid based chemicals from a chemical feed 22 connected to a chemical supply 20. The oxalic acid based chemicals soak in tank 10. Oxalic acid based chemicals may also be agitated in tank 10, for example, by circulation or gas sparging. Oxalic acid based chemicals may be added to chemical supply 20 directly from a mix tank and/or an online chemical addition mechanism. Chemical feed 22 may be, for example, a pump or other mechanism.

Oxalic acid based chemicals may include, for example, a solution having oxalic acid at a concentration of about 100 ppm to 30,000 ppm, and most preferably between 3000 ppm to 30,000 ppm, and a pH of approximately 1.5. This is applied in a temperature band from about ambient up to about 190° F. The solution may include, for example, deionized water. Once metallic species concentration in the solution has reached a desired or saturation concentration, the solution is drained. If the oxalic acid is added to the solution having a higher pH, for example, with ammonia added to the solution to increase the pH to greater than 1.5, but less than 3.0, the solution will have the ability to remove copper. The temperature band remains the same and the duration is dependent on the dissolution profile of the wastes. The amount of oxalic acid in the resulting oxalic acid/waste solution may vary from a few ppm to saturation.

The resulting oxalic acid/waste solution including chemical solvent and dissolved and mobilized sludge and/or deposits from tank 10 are transported via a waste feed line 12 to a decomposition unit 14. An oxidant feed supply 30 provides chemicals or substances used in the decomposition process, for example, hydrogen peroxide or ozone, to decomposition unit 14. Decomposition unit 14 drives the wet oxidation process and provides or removes energy to promote the radiolytic, chemical, and or thermal decomposition of the oxalic acid/waste solution. The oxidation process may occur below a boiling point of the solution. The wet oxidation process decomposes the oxalic acid based chemicals into water and carbon dioxide. Thus, the secondary waste includes water, carbon dioxide, waste precipitate and trace amounts of the chemicals used for cleaning.

The secondary waste is then transported from decomposition unit 14 to a solid separator 16. Solid separator 16 separates the solids of the secondary waste from the liquids. Solid separator 16 may be, for example, a centrifuge, or employ other separating methods, for example, barrier filtration or evaporation. The separated solids are transferred to a solids container 18 for temporary or permanent disposal. A water tank 50 collects water remaining from the chemical cleaning process. The water may be reused, monitored, treated and/or released to the environment.

An off gas mechanism 40 monitors and/or treats gasses created by off gas, for example, carbon dioxide. An off gas exit 42 releases gas remaining from the off gas treatment process. The requirements for treatment and/or monitoring are based on the oxalic acid based chemicals and the component being cleaned. In a nuclear related application, monitoring for radionuclides may be required.

At lower oxalic acid concentrations, for example, below 2500 ppm, the step of feeding an oxidant to the oxalic acid/waste solution to form a precipitate may be replaced or supplemented by processing the oxalic acid/waste solution through ion exchange media. Cation resins and anion resins can pick up oppositely charged metallic species, and in this way remove the waste. UV light can also be used to excite the solution at one or more wavelengths, for example at 190, 254 and/or 365 nm, with the optimum wavelengths selected as a function of the metallic species, metallic ion dissolved concentration and oxalic acid solution concentration. The waste solution may be alternately or further processed by reverse osmosis or other water purification treatment methods.

The removal of the nuclear waste preferably is dose-reduction independent, as the radioactivity of the waste is generally irrelevant to the purpose of its removal. For example, heat exchanger waste often is only slightly or not radioactive at all, and such waste removal is to improve heat-exchange properties. Tank waste, while often highly radioactive itself, is removed to clean the tank, which remains highly radioactive. The purpose of the removal of the waste is not dose-reduction of the tank, and no monitoring of dose reduction is necessary.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A method for removing nuclear waste from a secondary component located outside a primary coolant loop of a nuclear reactor comprising:

supplying oxalic acid to the nuclear waste on the secondary component to form an oxalic acid/waste solution;

cleaning the nuclear waste of the second component by feeding the oxalic acid/waste solution from the secondary component, the cleaning the nuclear waste from the secondary component being dose-independent;

feeding an oxidant to the oxalic acid/waste solution to form carbon-dioxide, water and a precipitate; and separating the precipitate from the water, wherein the primary coolant loop may be running while nuclear waste is removed from the secondary component.

2. The method as recited in claim 1 wherein the step of feeding an oxidant to the oxalic acid/waste solution occurs below a boiling point of the solution.

3. The method as recited in claim 2 wherein the step of feeding an oxidant to the oxalic acid/waste solution occurs at a temperature in the range from about ambient up to about 190° F.

4. The method as recited in claim 1 wherein the oxalic acid/waste solution includes between a few ppm of oxalic acid and oxalic acid saturation.

5. The method as recited in claim 1 wherein the secondary component is heat transfer equipment, a storage tank or a secondary piping system containing waste.

6. The method as recited in claim 1 wherein the step of supplying oxalic acid includes supplying a solution including oxalic acid.

7. The method as recited in claim 6 wherein the solution includes at least 100 ppm up to 30,000 ppm oxalic acid.

8. The method as recited in claim 6 wherein the solution includes between about 3,000 ppm up to about 30,000 ppm oxalic acid.

9. The method as recited in claim 6 wherein the solution includes more than 3,000 ppm oxalic acid.

10. The method as recited in claim 6 wherein the solution has a pH of about 1.5.

11. The method as recited in claim 6 wherein the solution has a pH between 1.5 and 3.

12. The method as recited in claim 1 wherein the solution remains in the component until a metallic species concentration reaches a desired solution or solution saturation concentration.

13. The method as recited in claim 1 wherein the oxidant includes hydrogen peroxide or ozone.

14. The method as recited in claim 1 wherein the method removes metallic, ionic or non-ionic species.

15. The method as recited in claim 1 further comprising the step of monitoring or treating gasses created by off gas.

16. The method as recited in claim 15 wherein the off gas is carbon dioxide.

17. The method as recited in claim 1 further comprising the step of collecting the water and further processing the water using ion exchange or water purification treatment.

18. The method as recited in claim 1 further comprising exciting the oxalic acid/waste solution with UV light.

19. The method as recited in claim 1 wherein the nuclear waste is radioactive waste in a tank, the tank also being radioactive.

20. The method as recited in claim 1 wherein the nuclear waste is non-radioactive waste in a heat-exchanger.

21. The method as recited in claim 1 wherein the secondary component is a heat exchanger.

22. The method as recited in claim 1 further comprising processing the solution by reverse osmosis.

23. The method as recited in claim 1 wherein the secondary component is a tank.

24. The method as recited in claim 1 wherein the nuclear waste removed is sludge.

* * * * *